United States Patent [19]

Curry

[11] Patent Number: 4,672,824

[45] Date of Patent: Jun. 16, 1987

[54] FLAT BED KNITTING MACHINES

[76] Inventor: Roger F. N. Curry, Little Egypt, The Playing Close, Charlbury, Oxford, United Kingdom

[21] Appl. No.: 902,367

[22] PCT Filed: Dec. 6, 1985

[86] PCT No.: PCT/GB85/00554

§ 371 Date: Aug. 1, 1986

§ 102(e) Date: Aug. 1, 1986

[87] PCT Pub. No.: WO86/03524

PCT Pub. Date: Jun. 19, 1986

[30] Foreign Application Priority Data

Dec. 6, 1984 [GB] United Kingdom ..... 8430775
Mar. 8, 1985 [GB] United Kingdom ..... 8508995

[51] Int. Cl.[4] ..... D04B 15/44
[52] U.S. Cl. ..... 66/146
[58] Field of Search ..... 66/146, 140, 145

[56] References Cited

U.S. PATENT DOCUMENTS 214,309 4/1879 Nelson ..... 66/140 R
2,115,610 4/1938 Ball ..... 66/146 R
3,797,279 3/1974 Kline et al. ..... 66/146 R

FOREIGN PATENT DOCUMENTS 1020436 12/1957 Fed. Rep. of Germany ..... 66/146
1023554 1/1958 Fed. Rep. of Germany ..... 66/146

*Primary Examiner*—Ronald Feldbaum
*Attorney, Agent, or Firm*—Biebel, French & Nauman

[57] ABSTRACT

A flat-bed knitting machine has yarn restraining devices (10) disposed adjacent opposite ends of the stroke of its cam box (4) for controlling the supply of yarn (Y) to the needles so that no loops are formed at the edges of the knitted fabric produced on the machine and no tension is applied to the yarn by the devices while the rows of stitches are being knit. Each device (10) comprises a spring arm (12) for engaging with a cooperating flat surface (17) on the top of the cam box (4) during movement thereof over a predetermined end portion of the stroke and for trapping the yarn (Y) between the arm (12) and the surface (17). The arm (12) is adapted to retain the yarn so trapped as the cam box (4) commences a reverse stroke and until the yarn is re-engaged by the cam box with the adjacent working needle, whereupon a pull is exerted on the yarn to release it as the cam box commences a fresh row of stitches.

10 Claims, 2 Drawing Figures

FLAT BED KNITTING MACHINES

Figure 1:
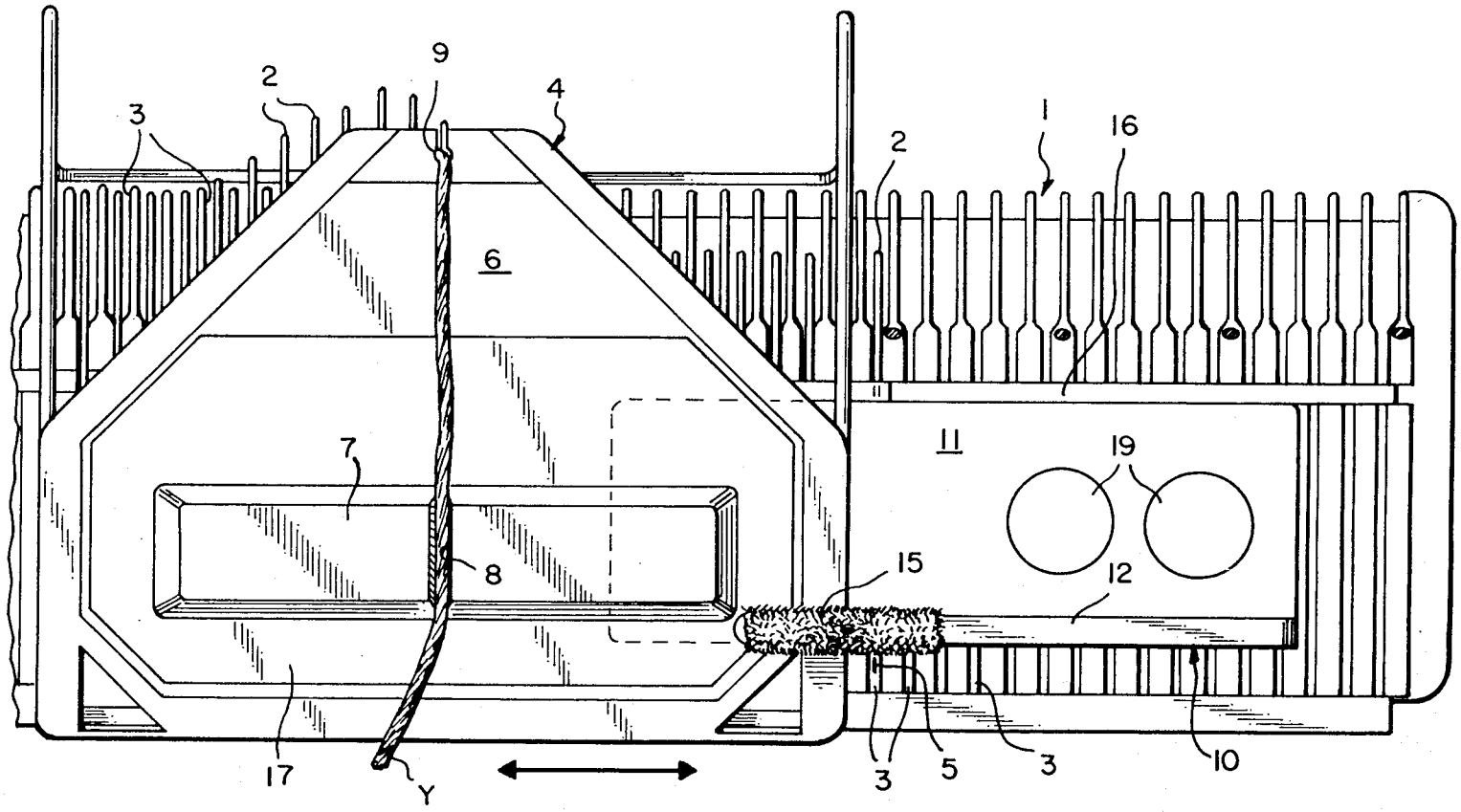

The present invention relates to flat-bed knitting machines and, more particularly, to yarn restraining devices for controlling the feeding of yarns to such knitting machines.

A flat-bed knitting machine conventionally comprises a flat elongated bed on which is mounted an array of parallel latchable knitting needles. The needles are disposed transversely to the length of the bed at equally spaced positions therealong and are reciprocable in the direction of their length so as to be sequentially projectable from one side of the bed. They are reciprocated in response to movement of a carriage or cam box slidable along the bed transversely to the needles and having a cam arrangement for engaging operating butts of the needles. The cam box is pushed backwards and forwards along the bed and, as the cam box is moved, the yarn is fed to the projecting front ends of the needles, via suitable guide means disposed on the cam box, so that each needle knits a stitch as it is reciprocated by the cam arrangement.

At the end of each stroke of the cam box along the bed, the cam arrangement must clear the operating butts of a selected array of working needles before it can commence a reverse stroke. Consequently, the cam box carries the yarn some distance past the end needle of the selected array before its movement can be reversed and this causes a loop of slack yarn to form at the start of the next row of stitches which can result in dropped stitches. The customary method of taking up this slack is to thread the yarn being supplied to the cam box through a guide assembly incorporating a spring device normally, either a wire or coil spring. The spring is kept under tension whilst a row of stitches is being knitted so that, when the cam clears an end working needle and the direction of movement of the cam box is reversed, the spring restores and takes up any slack yarn. A consequence of such conventional arrangements is that the yarn is always under tension during the knitting of a row of stitches and this tension must be controlled to avoid dmage to or jamming of the yarn, as it passes through the spring guide assembly, and to produce constant stitch sizes. This control is difficult to achieve with conventional arrangements.

An object of the present invention is to provide a yarn restraining device for a flat-bed knitting machine of the type described above, which is arranged to control the supply of yarn so that no loops are formed at the edges of the knitted fabric produced on the machine and which does not itself apply tension to the yarn whilst rows of stitches are being knitted, although the yarn may be otherwise tensioned.

The invention consists in a yarn restraining device for positioning on such a flat-bed knitting machine or at adjacent one end of the stroke of the cam box, which device comprises a spring arm for engaging with a cooperating surface on the cam box during movement thereof over a predetermined end portion of its stroke and for trapping the yarn between itself and said surface, said arm being adapted to retain the yarn so trapped as the cam box commences a reverse stroke and until the yarn is reengaged by the cam box with the adjacent end working needle, thereby to take up slack in the yarn produced at the end of a cam box stroke and avoid the formation of loops between rows of stitches.

In use, the two such yarn restraining devices are mounted on the bed of the knitting machine at opposite ends of a selected array of working needles. The cooperating surface on the cam box may be a surface of the cam box, itself, or alternatively, a surface on a component affixed to the cam box.

Conveniently, each yarn restraining device comprises an arm formed from spring strip material, such as spring metal strip, arranged to project longitudinally of the bed of the knitting machine and engage with a flat upper surface of the cam box. The cam box may have a central yarn guide adjacent the path of movement of the spring arm in contact with the cooperating surface of the cam box so that the yarn is automatically guided into a position in which it is trapped between the arm and the cam box as the latter approaches the end of its stroke. Preferably, the spring arm is associated with stop means for abutting the cam box at the end of its stroke. Such stop means is arranged to define the position where the cam box has cleared the working needles, so that its movement may be reversed, and ensures that the spring arm has moved to a position to trap the yarn. For example, in a preferred embodiment, the spring arm is fastened to a mounting plate which seats on the bed of the machine beyond the selected array of working needles and supports the arm above the bed in a position projecting towards the working needles. The arm is fastened to the plate at its end remote from the needles via an upright stop portion of the arm. The plate is formed with a retaining element for restraining movement of the plate relative to the bed. For example, the retaining element may be a flange on the plate which is engagable in a needle groove in the bed. The plate may be of such a length that when it is positioned on the bed adjacent an end working needle, the cam arrangement clears the adjacent end needle as the cam box abuts the upright stop portion of the arm and the cam box can commence a reverse stroke.

At the position where it is intended to engage with the cooperating surface on the cam box, the spring arm may be fitted with friction material for improving resistance to disengagement of the yarn from between the arm and the surface. For example, it may be fitted with a sleeve of one-way nap material or foam plastics material.

With the present invention, the yarn restraining device does not apply tension to the yarn whilst a row of stitches is being knitted and the yarn may be fed directly to the cam box for engagement with the knitting needles as they are reciprocated in response to movement of the cam box. It is arranged in such a way that it only engages the yarn at the end of a stroke of the cam box and, hence, a row of knitting, whereupon the yarn is held by friction against the cam box or any component fixed to or resting on the cam box. The spring arm is so arranged that the yarn is released at the right time by a pull, as the cam box commences a fresh row of stitches. Moreover, the invention facilitates operation of a flat-bed knitting machine and enables control of a wider range and type of yarns without becomming jammed. It does not tension the yarn during the knitting of the rows of stitches and alleviates damage to the textures of certain yarns.

Figure 2:
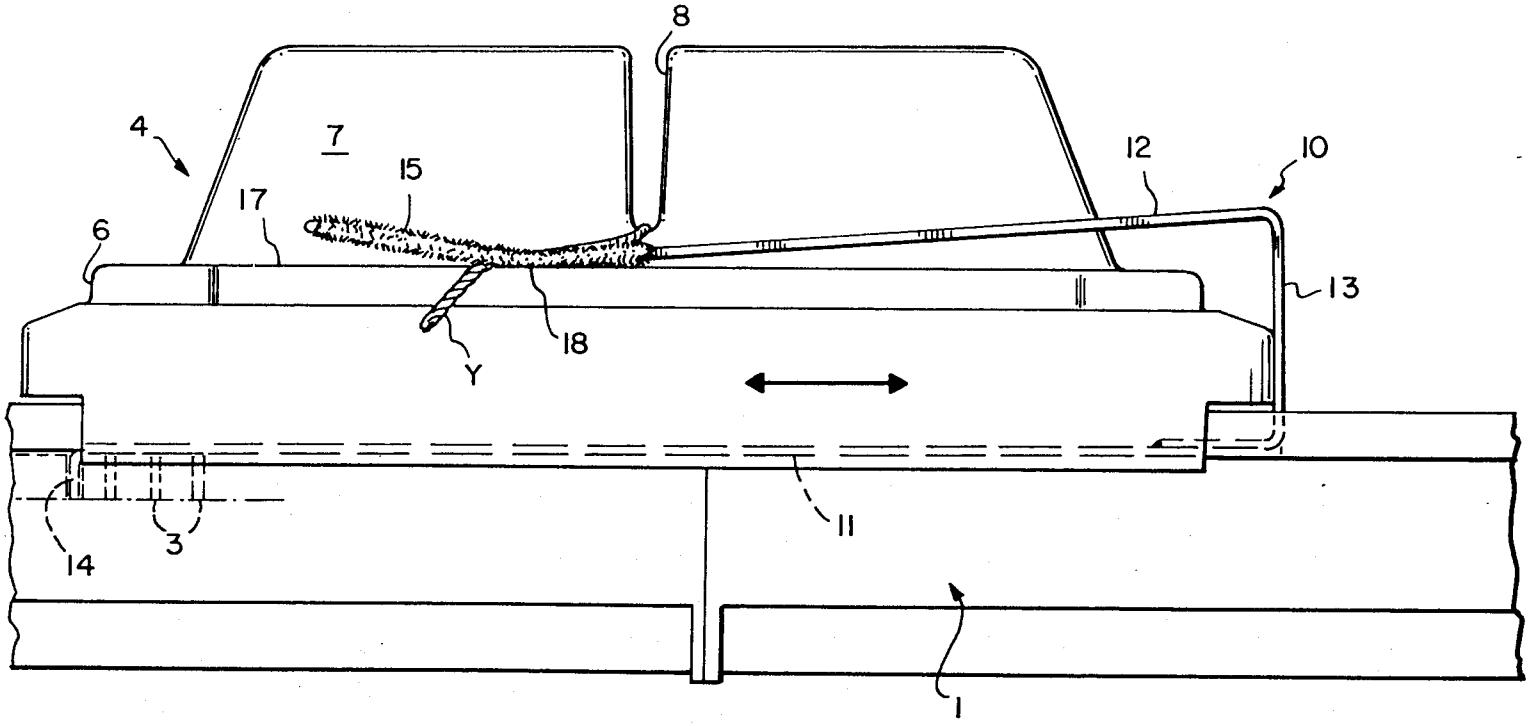

In order that the present invention may be more readily understood, reference will now be made to the accompanying drawings in which:

FIG. 1 is a fragmentary plan view of a domestic flat-bed knitting machine embodying the invention, and FIG. 2 is a fragmentary back view of the same part of the machine shown in FIG. 1.

The knitting machine illustrated in the drawings may be constructed and operated as described in prior British specification No. 2071709 and it will only be described herein insofar as is necessary for the understanding of the present invention.

Referring to the drawings, the flat-bed knitting machine includes a flat elongated bed 1 having a multiplicity of parallel latchable needes 2 retained in needle slots or grooves 3 disposed transversely of the bed at equally spaced positions therealong. The needles are sequentially reciprocable in a lengthwise direction, in order to produce a knitting action, by means of a cam box 4 slidably mounted for reciprocating movement along the bed, transversely to the needles 2, and having a cam plate (not shown) engageable with operating butts 5 adjacent the rear ends of the needles.

The cam box 4 includes an upper housing 6 which retains the cam plate in its receiving recess in the cam box and which incorporates a boss-like handle 7 which is arranged to be gripped by a user during operation of the machine for pushing the cam box back and forth along the bed 1. As the cam box is pushed back and forth, yarn Y is guided to the forward ends of the needles 2 for knitting rows of stitches via a guide slot 8 in the handle and a yarn guide groove 9 at the front of the cam box. The yarn Y may be supplied to the guide slot 8 from a ball or package of yarn supported on a nearby yarn holder (not shown), or, alternatively, from a package of the yarn simply lying on a table surface behind the machine.

When a fabric is knitted, the required number of working needles 2 for the width of fabric are cast on and the cam box 4 is pushed back and forth over the array of working needles to knit the rows of stitches. At each end of the stroke of the cam box, the machine is fitted with a yarn restraining device 10 for preventing the formation of loops of slack yarn at the edges of the knitting fabric and between consecutive rows of stitches. Only the restraining device 10 at one end of the bed is illustrated in the drawings. The device at the opposite end is identical except that it is oppositely handed.

Each device 10 comprises a rectangular mounting plate 11 having a spring arm 12 of strip material fastened to the plate adjacent the outer rear corner thereof. The spring arm 12 is connected to the plate via an upright stop portion 13 and projects from the upright portion over the plate and parallel to one side thereof. It is bent adjacent its free end so as to have a shallow V-shape in elevation which provides a cam box engaging portion 18 and this end portion is fitted with a sleeve 15 of one-way nap material, the purpose of which will be apparent from the following description. At its inner end, the plate has a marginal portion bent downwardly to form a retaining flange 14. The plate 11 and spring arm 12 are conveniently made from steel with the arm being welded to the plate. Openings 19 may be stamped in the plate to reduce the amount of material required.

In use, the plate 11 is seated on the bed of the knitting machine immediately beyond one end of the array of working needles. The flange 14 is engaged in the needle groove 3 next adjacent the end working needle 2 and the length of the plate is such that when the cam box 4 abuts the stop portion 13 at the end of its stroke, the cams on the cam plate have cleared the end working needle and the stroke of the cam box can be reversed. The plate 11 is seated on the bed against the forward slideway 16 for the cam box and its width is such that it may fit between this slideway and the operating butts 5 of the knitting needles which are not cast on and thereby prevent these needles from moving and interfering with the knitting operation. As the cam box approaches the end of its stroke, the spring arm 12 is arranged to engage the flat upper surface 17 of the cam box housing 6, immediately behind the handle 7 and slide in contact therewith. When the cam box 4 abuts the stop portion 13, the apex of the V-shaped end portion of the arm has moved just beyond the guide slot 8 in the handle 7 and traps the yarn Y between the spring arm and the upper surface 17 of the cam box housing. When the direction of movement of cam box is reversed upon abutting the stop portion 13, the one-way nap material 15 serves to retain the yarn trapped between the spring arm 12 and the cam box surface 17 so that, as the cam box commences its reverse stroke, the yarn Y is pulled along the surface behind the handle 7 and surplus or slack yarn is taken up and prevented from forming a loop of slack yarn between consecutive rows of stitches. When the yarn Y guided through the guide groove 9 in the front of the cam box engages the adjacent end working needle, the resulting tension is sufficient to pull the yarn free from between the spring arm and the cam box surface, whereupon it can again move freely through the guides 8, 9 for knitting the succeeding row of stitches. If for some reason, the yarn gets caught, it will in any event release very soon after engaging the end working needle, when the spring arm disengages the cam box surface 17, so as to remove the tension from the yarn.

Whilst a particular embodiment has been described, it will be understood that modifications can be made without departing from the scope of the invention as defined by the appended claims.

I claim:

1. A yarn restraining device (10) for positioning on a flat-bed knitting machine of the type described at or adjacent one end of the stroke of the cam box (4), said device being characterised by a spring arm (12) for engaging with a cooperating surface (17) of the cam box during movement thereof over a predetermined end portion of its stroke and for trapping the yarn (Y) between itself and said surface (17), said arm (12) being adapted to retain the yarn so trapped as the cam box commences a reverse stroke and until the yarn is reengaged by the cam box with the adjacent end working needle (2), whereby to take up slack in the yarn produced at the end of a cam box stroke and avoid the formation of loops between the rows of stitches.

2. A flat-bed knitting machine of the type described and having means (10) for taking up slack in the yarn (Y) at the ends of the cam box stroke so as to avoid the formation of loops between rows of stitches, characterised in that said means comprises two yarn restraining devices (10) disposed on the bed (1) of the knitting machine adjacent opposite ends of a selected array of working needles (2), each said device (10) comprising a spring member (12) arranged to engage with a cooperating surface (17) movable with the cam box (4) during movement thereof over a predetermined end portion of its stroke adjacent the device for trapping the yarn (Y) between itself and said surface (17), said spring member (12) being adapted to retain the yarn so trapped as the cam box (4) commences a reverse stroke and until the yarn is re-engaged with the adjacent end working needle (2).

3. A knitting machine according to claim 2, characterised in that said cooperating surface is a surface (17) of the cam box (4).

4. A knitting machine according to claim 3, characterised in that the spring member (12) of each yarn restraining device (10) is an elongate spring arm formed from spring strip material, for example, spring metal strip, arranged to project longitudinally of the bed (1) of the knitting machine and to engage with a flat upper surface (17) of the cam box (4), and in that the cam box (4) has a yarn guide (8) disposed adjacent the path of movement of the spring arm in contact with said surface (17) of the cam box so that the yarn (Y) is automatically guided into a position in which it is trapped between the arm and the surface as the cam box approaches each end of its stroke.

5. A knitting machine according to claim 4, characterised in that, at the position where the spring arm (12) engages with the cooperating surface (17) of the cam box, said spring arm is provided with friction material (15), for example, is fitted with a sleeve of one-way nap material or foam plastics material, for improving resistance to disengagement of the yarn (Y) from between the arm and the surface.

6. A knitting machine according to claim 4, characterised in that the spring arm (12) of each restraining device is associated with stop means (13) for abutting the cam box (4) at the end of its stroke, said stop means (13) being arranged to define a position where the cam box is clear of the working needles (2), so that its movement may be reversed, and said spring arm has moved to a position to trap the yarn.

7. A knitting machine according to claim 6, characterised in that the spring arm (12) of each restraining device is fastened to an individual mounting plate (11) which is seated on the bed (1) of the machine beyond the selected array of working needles (2) and supports the arm in a position above the bed and projecting longitudinally towards the working needles, said arm being fastened to the plate at its end remote from said working needles via an upright portion (13) of the arm forming said stop means.

8. A knitting machine according to claim 7, characterised in that each plate (11) is formed with a retaining element (14) for restraining movement of the plate relative to the bed (1) of the knitting machine.

9. A knitting machine according to claim 8, characterised in that the retaining element is a flange (14) disposed at the end of the plate (11) remote from said stop portion (13) and engageable with a needle groove (3) in the bed (1), each said plate being of such a length that, when it is positioned on the bed (1) adjacent an end working needle (2), the cam arrangment of the cam box (4) clears the adjacent end needle as the cam box abuts the stop portion (13) of the arm, whereupon the cam box can commence a reverse stroke.

10. A method of operating a flat-bed knitting machine of the type described, characterised by the steps of guiding yarn (Y) being knitted adjacent a surface (17) movable with the cam box, trapping said yarn against said surface at each end of the cam box stroke as the cam arrangement housed by the cam box (4) clears the adjacent end working needle (2), and retaining said yarn (Y) so trapped as the cam box (4) commences a reverse stroke and until the yarn is re-engaged with the adjacent end working needle, whereupon the resulting tension pulls the yarn free, thereby to alleviate the formation of loops at the edges of the knitted fabric and the application of undesirable tension to the yarn whilst a row of stitches is being knitted.

* * * * *